US010340069B2

(12) United States Patent
Schulze et al.

(10) Patent No.: US 10,340,069 B2
(45) Date of Patent: Jul. 2, 2019

(54) CENTRAL ACTUATOR FOR CAM PHASER

(71) Applicant: ECO Holding 1 GmbH, Marktheidenfeld (DE)

(72) Inventors: Dietmar Schulze, Muenzenberg (DE); Volker Stenger, Hoesbach (DE)

(73) Assignee: ECO Holding 1 GmbH, Marktheldenfeld (DE)

( * ) Notice: Subject to any disclaimer, the term of this patent is extended or adjusted under 35 U.S.C. 154(b) by 109 days.

(21) Appl. No.: 15/650,873

(22) Filed: Jul. 15, 2017

(65) Prior Publication Data

US 2017/0345538 A1 Nov. 30, 2017

Related U.S. Application Data

(63) Continuation of application No. PCT/EP2016/052311, filed on Feb. 3, 2016.

(30) Foreign Application Priority Data

Feb. 13, 2015 (DE) ..... 10 2015 102 066

(51) Int. Cl.

| | |
|---|---|
| ***H01H 7/16*** | (2006.01) |
| ***H01F 7/16*** | (2006.01) |
| ***H01F 7/127*** | (2006.01) |
| *H01F 7/128* | (2006.01) |
| *F01L 1/344* | (2006.01) |

(52) U.S. Cl.

CPC ..... *H01F 7/16* (2013.01); *H01F 7/127* (2013.01); *H01F 7/1607* (2013.01); *F01L 1/3442* (2013.01); *F01L 2001/3443* (2013.01); *H01F 7/128* (2013.01); *H01F 2007/163* (2013.01)

(58) Field of Classification Search

CPC ..... H01F 7/16; H01F 7/1607

See application file for complete search history.

(56) References Cited

U.S. PATENT DOCUMENTS

| | | | | |
|---|---|---|---|---|
| 3,900,822 | A | 8/1975 | Hardwick et al. | |
| 7,209,020 | B2 * | 4/2007 | Telep | H01F 7/13 335/255 |
| 8,350,652 | B2 * | 1/2013 | Hoppe | F01L 1/3442 310/12.31 |

(Continued)

FOREIGN PATENT DOCUMENTS

| | | | |
|---|---|---|---|
| CN | 101287894 | A | 10/2008 |
| DE | 10196576 | B4 | 1/2005 |

(Continued)

*Primary Examiner* — Ramon M Barrera

(74) *Attorney, Agent, or Firm* — Von Rohrscheidt Patents

(57) ABSTRACT

A central actuator for a magnet valve of a cam phaser, the central actuator including a housing that envelops the central actuator; a pole tube and a pole core that are arranged within at least one coil that generates a magnetic field; an actuation plunger that is arranged at an armature that is axially movable in a direction in an armature cavity; a closure element that closes the armature cavity, wherein the closure element includes at least one pole core insert that includes a central bore hole and a support bushing that is arranged in the central bore hole of the pole core insert, wherein the actuation plunger is supported axially movable in the support bushing, and wherein the closure element includes a closure cover and is provided as a pre-assembled module.

11 Claims, 3 Drawing Sheets

(56) References Cited

U.S. PATENT DOCUMENTS

| | | | | |
|---|---|---|---|---|
| 8,427,263 | B2 * | 4/2013 | Hoppe | H01F 7/081 335/255 |
| 2004/0011982 | A1 | 1/2004 | Hirata et al. | |
| 2004/0041114 | A1 | 3/2004 | Hirata et al. | |
| 2004/0257185 | A1 | 12/2004 | Telep | |
| 2010/0025606 | A1 | 2/2010 | Hoppe et al. | |

FOREIGN PATENT DOCUMENTS

| | | | |
|---|---|---|---|
| DE | 102005048732 | A1 | 4/2007 |
| DE | 102005049663 | A1 | 4/2007 |
| DE | 102006042214 | A1 | 3/2008 |
| DE | 102010014140 | A1 | 10/2011 |
| DE | 102010060264 | A1 | 5/2012 |
| EP | 2362125 | A1 | 8/2011 |

* cited by examiner

CENTRAL ACTUATOR FOR CAM PHASER

RELATED APPLICATIONS

This application is a continuation of International Application PCT/EP2016/052311 filed on Feb. 3, 2016 claiming priority from German Patent Application DE 10 2015 102 066.1 filed on Feb. 13, 2015, both of which are incorporated in their entirety by this reference.

FIELD OF THE INVENTION

The invention relates to a central actuator, in particular for a magnet valve of a cam phaser for an internal combustion engine of a motor vehicle.

BACKGROUND OF THE INVENTION

DE10 2005 049 663 A1 discloses an electromagnet with a cylindrical hollow magnet body which includes a yoke, a pole core with an opposite armature element that influences the characteristic curve and a housing, and a cylindrical coil and a cylindrical armature with a support rod and an armature piston that is movably arranged relative to the pole.

In an electromagnet the armature piston is supported axially movable in a support tube or a support sleeve, wherein the support tube or the support sleeve terminates at an end within the pole core or within the armature opposing element of the pole core and extends at another end beyond the yoke, in particular to the transversal wall of the housing and includes the sleeve base at this end in case it is configure as a support sleeve. The pole core or its armature opposing element which is penetrated by the support rod closes the housing.

BRIEF SUMMARY OF THE INVENTION

Thus, it is object of the invention to provide a central actuator that can be produced in a cost effective manner and mounted in a simple manner, in particular for a magnet valve of a cam phaser.

The object is achieved according to an aspect of the invention by a central actuator for a magnet valve of a cam phaser, the central actuator including a housing that envelops the central actuator; a pole tube and a pole core that are arranged within at least one coil that generates a magnetic field; an actuation plunger that is arranged at an armature that is axially movable in a direction in an armature cavity; a closure element that closes the armature cavity, wherein the closure element includes at least one pole core insert that includes a central bore hole and a support bushing that is arranged in the central bore hole of the pole core insert, wherein the actuation plunger is supported axially movable in the support bushing, and wherein the closure element includes a closure cover and is provided as a pre-assembled module.

Advantageous embodiments and advantages of the invention can be derived from the dependent claims, the description and the drawing figures.

A central actuator is proposed, in particular for a magnet valve of a cam phaser wherein the central actuator includes a housing which envelops the central actuator. The central actuator furthermore includes a pole tube and a pole core which are arranged within at least one coil generating a magnetic field and an actuation plunger which is arranged at an armature which is supported axially movable in an armature cavity.

According to the invention a closure element is provided for closing the armature cavity wherein the closure element includes at least one pole core insert with a central bore hole and a support bushing arranged in the central bore hole of the pole core insert, wherein the actuation plunger is supported in the support bushing axially movable and wherein the closure element furthermore includes a closure cover and is provided as a module that can be preassembled.

The module that can be preassembled facilitates simple mounting and axial fixation of the pole core insert.

The actuation plunger is additionally safely supported in the support bushing so that also a support of the armature at which the actuation plunger is arranged is provided.

Advantageously the closure cover includes a central bore hole in which the support bushing is arranged which facilitates easy positioning of the unit.

Advantageously the support bushing is produced by an injection molding method and the closure cover and the pole core insert are provided as inserts which are incased through injection molding by the material of the support bushing in the portion of their of their central boreholes. The injection molding provides a simple and very cost effective fabrication method which facilitates producing the closure element in a simple and cost effective manner.

According to an advantageous embodiment of the invention the support bushing includes axially arranged recesses for providing a pressure compensation between the armature cavity and an exterior space of the central actuator.

The pressure compensation provides a volume compensation of the enclosed hydraulic fluid or the enclosed air between the armature cavity and an external space of the central actuator. This pressure compensation is important for dry operations, thus an air filled armature cavity as well as for operations with hydraulic fluid in the armature cavity. Even when hydraulic fluid has to be kept out of the portion outside of the pole tube the hydraulic fluid within the pole tube is of great advantage since it can provide a pressure compensation on both sides of the armature. By the same token the lubrication effect of the hydraulic fluid is advantageous since it provides a reduction of friction and wear.

Thus, recesses in the support bushing are provided in a particularly advantageous embodiment wherein the support bushings run the hydraulic fluid from the hydraulic portion of a magnet valve to an electromagnetic portion of the magnet valve, thus the central actuator so that the closure element is loaded with the same hydraulic pressure on both sides. However, it is also conceivable to arrange the recesses in the pole core insert and in the closure cover.

The support bushing advantageously includes a shoulder as a stop for the armature on a side of the support bushing that is oriented towards the armature. A fixed stop keeps the face of the armature at a certain distance from the disc shaped pole core insert and thus prevents a sticking of the armature with the face of the armature at the pole core insert. The sticking would change the movement properties of the armature and significantly influence the magnetic forces that are required for operating the armature so that the entire dynamic properties of the central actuator would be changed. Therefore a shoulder of this type configured as anti-stick disc can positively influence the dynamic properties and the energy consumption of a central actuator that is operated with magnetic forces.

Advantageously the actuation plunger can be pressable into a central bore hole of the armature. The armature and the actuation plunger are typically made from different materials. The armature is advantageously made from soft iron whereas the actuation plunger is advantageously made from non-ferrous metal in order to have the required material properties like hardness for operating a magnet valve. The armature, however, essentially has to have the correct magnetic properties for operating in the magnet loop of the coil. Therefore the armature can be for example provided with a bore hole into which the actuation plunger is insertable and advantageously impressable which facilitates a cost effective and durable connection between the armature and the actuation plunger.

According to an advantageously embodiment of the invention the actuation plunger can have one or plural transversal bore holes between the armature and the support bushing for pressure compensation between a front side and a back side of the armature wherein the transversal bore holes lead into a central longitudinal bore hole leading into the bore hole of the armature.

Another advantageous embodiment of the invention provides that the actuation plunger includes flat spots which extend on both sides beyond a press in portion of the bore hole and the bore hole is configured with shoulders and includes a larger inner diameter which starts in the portion of the flat portions. The flat portions and the enlarged inner diameter can be produced in a simple and cost effective manner so that the volume and pressure compensation can be produced in a simple and cost effective manner.

Alternatively the actuation plunger and the armature can be provided integral in one piece wherein omitting the bore hole for receiving the plunger yields a high magnetic force and a compact configuration. Furthermore this helps to improve coaxial alignment of both components. In this embodiment the armature can be produced in a cost effective manner from a machining steel.

According to an advantageous embodiment of the invention the armature can be movably supported in a non-magnetic sleeve oriented in an axial direction towards the pole core insert.

When the sleeve has an inner diameter that is uniform over an entire operating range traveled by the armature, the armature can be supported over its entire length and it is assured that the armature cannot misalign itself at a slant angle which would otherwise lead to high magnetic radial forces upon the armature and thus to high friction relative to the pole tube.

When the pole tube and the pole core are configured integral in one piece the armature is configured axially moveable in a direction oriented towards the pole core insert a support of the armature can also be assured in an alternative embodiment.

Advantageously the armature includes a diameter shoulder as a support surface at an end of the armature that is oriented towards the closure element which provides support in the armature cavity. With the support of the actuation plunger in the support bushing as a second support location this two point support with large bearing spacing provides good support for the armature since small coaxial errors from an outer diameter of the pole core insert to an inner diameter of the support bushing and from an armature outer diameter and a plunger outer diameter can be compensated.

The support surface of the armature can be configured polygonal according to an embodiment and can include circumferentially evenly spaced flat spots for providing pressure compensation between a front side and a back side of the armature.

A particularly advantageous alternative embodiment provides the support surface of the armature as a cylindrical diameter shoulder with an increased outer diameter.

Advantageously the housing can be produced through a plastic injection molding method. This way it is possible to produce the housing of the central actuator from an injection moldable plastic material in a cost effective manner if the various components of the pole yoke are inserted during the injection molding method, wherein the components facilitate the closed magnetic flow. The housing is closed by a closure cover relative to an exterior space of the central actuator wherein the closure cover is advantageously attached at the housing by ultra sound riveting.

BRIEF DESCRIPTION OF THE DRAWINGS

Further advantages of the invention can be derived from the subsequent drawing description. The drawing figures schematically illustrate an embodiments of the invention. The drawing figures, the description and the patent claims include numerous features in combination. A person skilled in the art will advantageously also view the features individually and combine them into useful additional combinations, wherein:

FIG. 6 illustrates an enlarged view of the armature with the actuation plunger according to the third embodiment according to FIG. 5 pressed in.

DETAILED DESCRIPTION OF THE INVENTION

Figure 2:
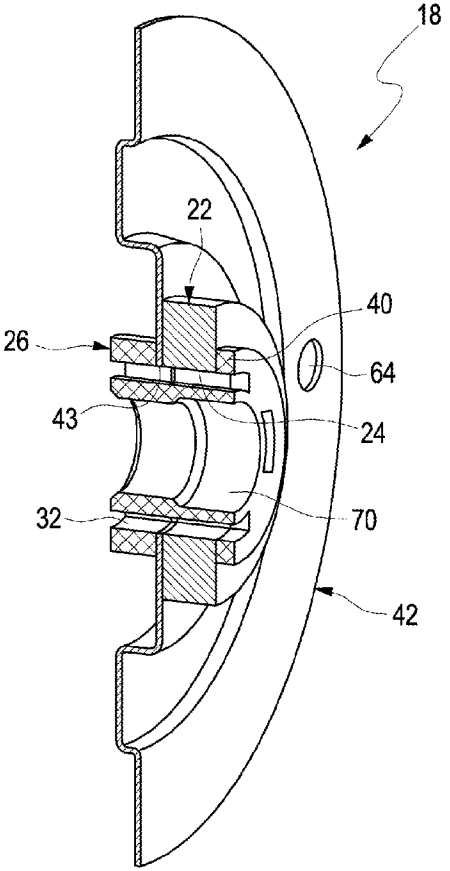
FIG. 2 illustrates a sectional view through the closure element of the central actuator according to FIG. 1.

In the drawing figures identical or like components are designated with identical reference numerals. The figures merely illustrate embodiments and do not limit the spirit and scope of the invention.

Figure 1:
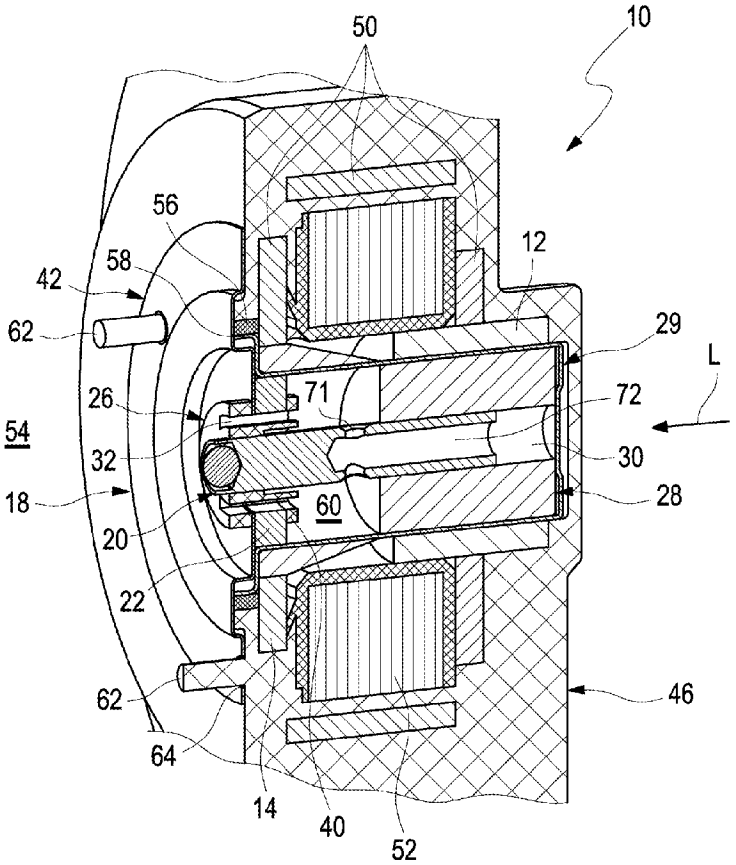
FIG. 1 illustrates a sectional view through a central actuator according to a first embodiment of the invention.

FIG. 1 illustrates a sectional view of a central actuator 10 according to a first embodiment of the invention. The central actuator 10, that is configured in particular for a magnet valve of a cam phaser thus includes a pole tube 12 that is arranged within a cylindrical coil 52 that forms a magnet field and a housing 46 which envelops the central actuator 10. The housing 46 is produced by a plastic injection molding method so that it can be produced in a cost effective manner by inserting the various components of a pole yoke 50 during the injection molding process to provide the closed magnetic flux.

Furthermore the central actuator 10 includes a closure element 18 that is illustrated in FIG. 2 in a blown up view and which closes the housing 46 wherein the closure element 18 includes a pole core insert 22 with a central bore hole 24 and a support bushing 26 that is arranged in the central bore hole 24 of the pole core insert 22.

Furthermore the closure element includes a closure plate 42 and the closure element is provided as a pre assemble able module.

The closure cover 42 is attached at the housing 46 for example by ultra sound riveting. For this purpose the housing 46 has an ultra sound geometry configured with plural protrusions 42 which penetrate through bore holes 64 of the closure cover 42. The protrusions 62 are melted and deformed by the ultra sound riveting so that the closure cover 42 is safely attached at the housing 46.

As evident in particular from FIG. 2 the closure cover 42 includes a central bore hole 43 in which the support bushing 26 is arranged.

Advantageously the support bushing 26 is produced by a plastic injection molding method and the closure cover 42 and the pole core insert 22 are provided as inserts which are inserted into the injection molding tool when producing the support bushing 26 and the inserts are encased through injection molding by the material of the support bushing in a portion of central bore holes 24, 43 of the inserts. This provides a permanent sealing of the support bushing 26 against the pole core insert 22 and the closure cover 42.

An actuation plunger 20 is arranged at an armature 28 which is movably supported in an axial direction L oriented towards the pole core insert 22 within an armature cavity 60. The actuation plunger is supported axially moveable in the support bushing 26 whereas the armature 28 is supported in a non-magnetic sleeve 29. The non-magnetic sleeve 29 is supported in the pole tube 12 and in a pole core 14. It is evident that the sleeve 29 extends up to an end of an armature cavity 60 that is closed by the closure cover 42 and has a continuous inner diameter in an entire operating range that is traveled by the armature 28 so that the armature 28 can be supported over its entire length. This assures furthermore that the armature 28 cannot wedge at a slant angle which would otherwise lead to high radial forces upon the armature 28 and thus to a high friction relative to the pole tube 12. Sealing the sleeve 29 is performed by an annular seal element 56 which is arranged between a shoulder 58 of the sleeve 29 and the housing 46 and which contacts the closure cover 42 and a portion of the pole yoke 50 in a sealing manner.

According to a non-illustrated embodiment the pole tube 12 and the pole core 14 can be produced integrally in one piece. Thus, the sleeve 29 can be omitted in this case and the armature 28 is configured axially movable in a direction oriented towards the pole core insert.

The support bushing 26 includes axially arranged recesses 32 to provide a pressure compensation between the armature cavity 60 and an outer space 54 of the central actuator 10. The pressure compensation provides a volume compensation of the enclosed hydraulic fluid or of the enclosed air between the armature cavity 60 and an exterior space of the central actuator 10. A pressure compensation of this type is important for dry operations, thus an air filled armature cavity 60 as well as for operations with hydraulic fluid in the armature cavity 60.

The support bushing 26 includes a shoulder 40 configured as a stop of the armature 28 at a side of the support bushing 26 that is oriented towards the armature 28 during an axial movement of the armature 28. A fixed stop of this type keeps the face of the armature 28 at a certain distance from the disc shaped pole core insert 22 and thus prevents a sticking of the armature 28 with the face of the armature 28 at the pole core insert 22. A sticking would change the movement properties of the armature 28 and significantly influence magnetic forces required to operate the armature 28 so that the entire dynamic properties of the central actuator 10 would thus be changed. Therefore the shoulder 40 configured as an anti-stick disc can positively influence the dynamic properties and the energy consumption of a central actuator 10 that is operated by magnetic forces.

The actuation plunger 20 is pressable into a central bore hole 30 of the armature 28. When the actuation plunger 20 is made from a different material than the armature 28 this provides an advantageous solution for connecting both components. The pole yoke 50 which can be configured from plural plates and/or tubes envelops the coil 52 on its outsides wherein the coil 52 is completely enveloped by magnetic material since the pole tube 12 is configured in an interior of the coil 52. Thus, the magnetic flux generated by the coil 52 is advantageously focused upon the volume portion in which the armature 28 can move.

This facilitates a pressure compensation between a front side and a back side of the armature 28 in that the actuation plunger 20 includes one or plural transversal bore holes 71 which lead into a central longitudinal bore hole 72 leading into the bore hole 30 of the armature 28 so that the armature 28 is loaded with the same hydraulic pressure on both sides.

The armature 28 can furthermore be supported by a two point support as will be described with reference to a subsequent embodiment.

Figure 4:
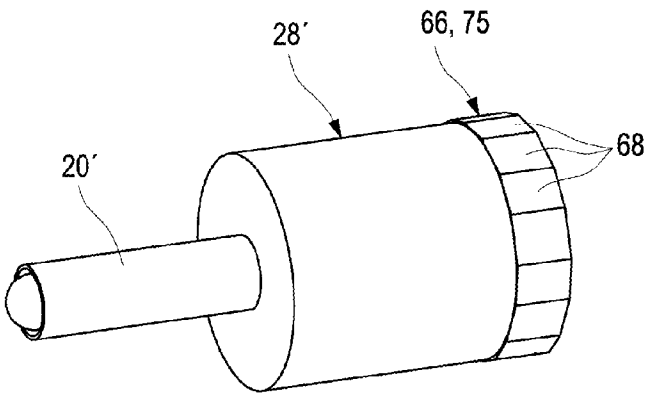
FIG. 4 illustrates an armature according to the second embodiment according to FIG. 3.
Figure 3:
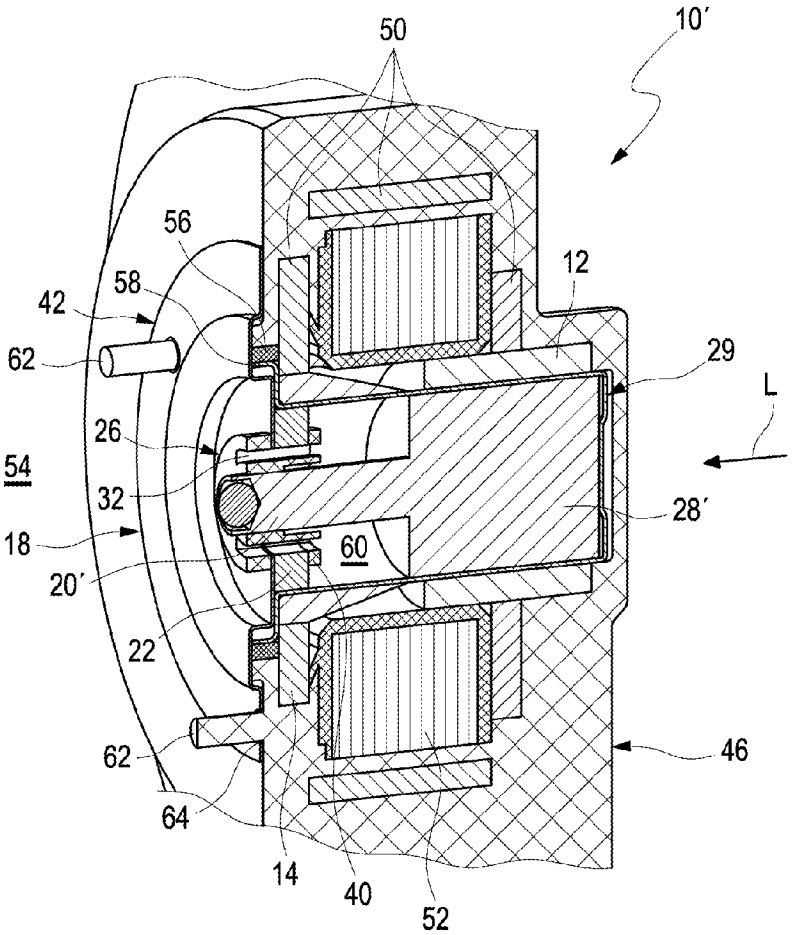
FIG. 3 illustrates a sectional view of a central actuator according to a second embodiment of the invention.

FIG. 3 illustrates a sectional view through a central actuator 10 according to a second embodiment of the invention. This differs from the first embodiment only in that the armature 28' and the actuation plunger 20' are produced integrally in one piece. The two components illustrated in FIG. 4 are thus made from the same material and the actuation plunger 20' can be made from a soft magnetic material like the armature 28'. Thus, a central actuator 10' can be constructed that is very compact.

A support surface 66 at an end of the armature 28' that is oriented away from the closure element 18 can be configured polygonal as a diameter shoulder 75 and includes flat areas 68 that are uniformly spaced in a circumferential direction wherein the flat areas facilitate a pressure compensation between the front side and back side of the armature 28'.

The diameter shoulder 75 operating as a support surface 66 forms a first bearing location of the armature 28'. The support of the actuation pin 20' in a stepped recess 70 of the support bushing 26 is used as a second support for the armature 28' which is illustrated in particular in FIG. 2. This two point support with large bearing distance facilitates good support for the armature 28' since small coaxial errors from an outer diameter of the pole core insert 22 to an inner diameter of the support bushing 26 and from an armature outer diameter and a plunger outer diameter can be compensated.

Figure 5:
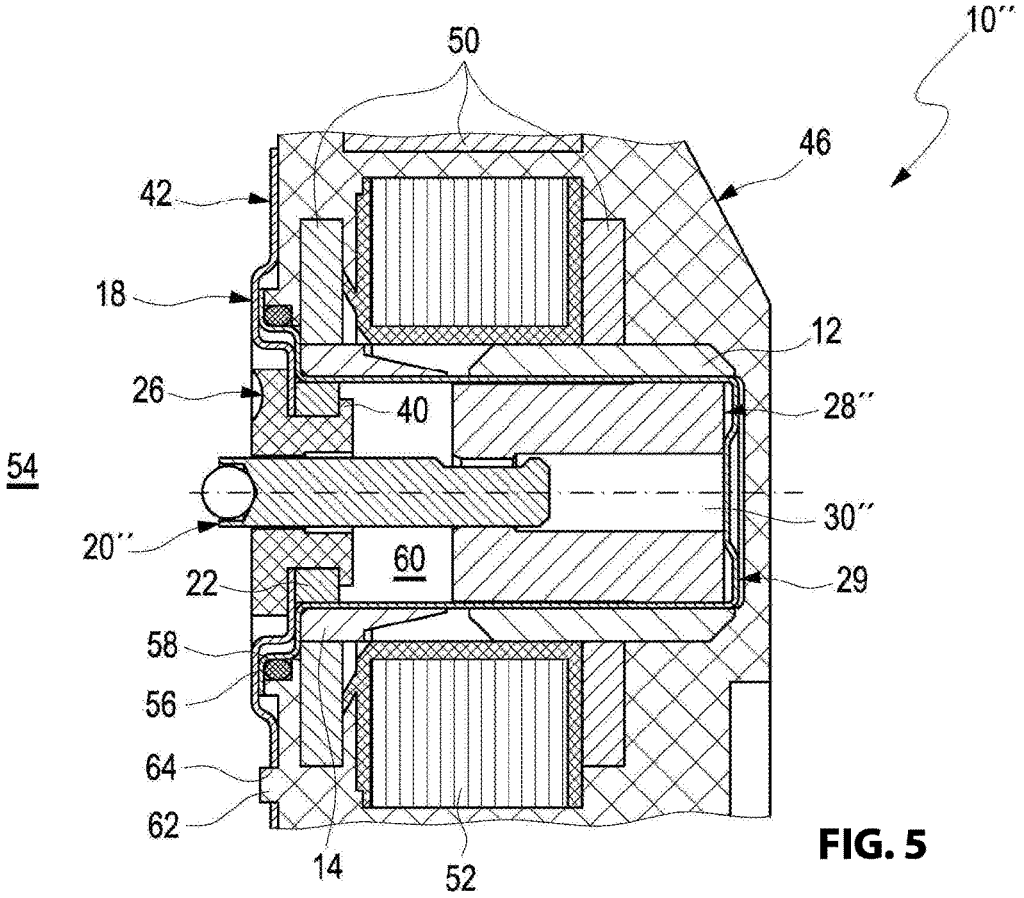
FIG. 5 illustrates a sectional view through a central actuator according to a third embodiment of the invention.
Figure 6:
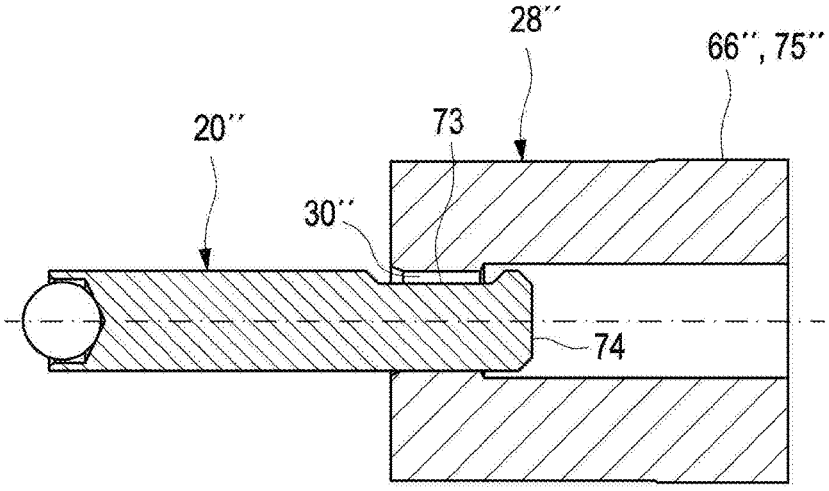

FIGS. 5 and 6 illustrate another embodiment of the invention which differs from the first embodiment essentially by a configuration of the pressure compensation between the front side and the back side of the armature 28".

As also described with respect to the first embodiment the actuation plunger 20" is pressed into a central bore hole 30" of the armature 28". Differently therefrom the essentially cylindrical actuation plunger 20" includes flat areas 73 in the press in portion wherein the flat areas are for example milled or fabricated through eccentrical turning in order to provide a volume or pressure compensation between a front side and a back side of the armature 28". The illustrated embodiment includes three flat areas 73 that are distributed over the circumference.

As illustrated in particular from FIG. 6 which illustrates the armature 28" with the pressed in actuation plunger 20" in a blown up sectional view the flat areas 73 extend on both sides beyond the press in portion of the bore hole 30".

In order to configure the actuation plunger 20" without points and thus facilitate a cost effective production the flat areas 73 do not extend to an end 74 of the actuation plunger 20". The bore hole 30" is configured with shoulders and includes an inner diameter that is increased and starts in a portion of the flat areas 73 in order to facilitate a volume compensation through the flat spots 73 and the end 74. This allows omitting axial bore holes in the armature 28" or longitudinal flat spots at the outside of the armature 28" which would be expensive to fabricate at the armature and which impact the magnetic force negatively.

In order to provide the described advantageous two point support the armature 28" includes a cylindrical diameter shoulder 75" in an end portion wherein the diameter shoulder forms the support surface 66" with an enlarged outer diameter.

REFERENCE NUMERALS AND DESIGNATIONS

10, 10', 10" central actuator
12 pole tube
14 pole core
18 closure element
20, 20', 20" actuation plunger
22 pole core insert
24 bore hole
26 support bushing
28, 28', 28" armature
29 sleeve
30, 30" bore hole
32 recess
40 shoulder
42 closure cover
43 bore hole
46 housing
50 pole yoke
52 coil
54 outer space
56 seal element
58 shoulder
60 armature cavity
62 protrusion
64 bore hole
66, 60" support surface
68 flat area
70 recess
71 transversal bore hole
72 longitudinal bore hole
73 flat area
74 end
75, 75" diameter shoulder
L direction

What is claimed is:

1. A central actuator for a magnet valve of a cam phaser, the central actuator comprising:
a housing that envelops the central actuator;
a pole tube and a pole core that are arranged within at least one coil that generates a magnetic field;
an actuation plunger that is arranged at an armature that is axially movable in a direction in an armature cavity;
a closure element that closes the armature cavity,
wherein the closure element includes at least one pole core insert that includes a central bore hole and a support bushing that is arranged in the central bore hole of the at least one pole core insert,
wherein the actuation plunger is supported axially movable in the support bushing,
wherein the closure element includes a closure cover and is provided as a pre-assembled module,
wherein the closure cover includes a central bore hole in which the support bushing is arranged, and
wherein the support bushing is produced by a plastic injection molding method and the closure cover and the at least one pole core insert are discrete components that are encased and fixed at each other through injection molding by a material of the support bushing in a portion of the central bore hole of the at least one pole core insert and in a portion of the central bore hole of the closure cover.

2. The central actuator according to claim 1, wherein the actuation plunger is pressable into a central bore hole of the armature.

3. The central actuator according to one claim 1, wherein the actuation plunger is made from a soft magnetic material.

4. The central actuator according to claim 1,
wherein the actuation plunger includes at least one transversal bore hole between the armature and the support bushing,
wherein the at least one transversal bore hole provides a pressure compensation between a front side and a back side of the armature, and
wherein the at least one transversal bore hole leads into a central longitudinal bore hole that leads into the central bore hole of the armature.

5. The central actuator according to claim 1,
wherein the actuation plunger includes flat areas which extend on both sides beyond a press in portion of the central bore hole, and
wherein the central bore hole is configured with at least one shoulder and includes an enlarged inner diameter that starts in the portion of the flat areas.

6. The central actuator according to claim 1, wherein the actuation plunger and the armature are provided integral in one piece.

7. The central actuator according to claim 1, wherein the armature is movably supported in a nonmagnetic sleeve in an axial direction oriented towards the pole core insert.

8. The central actuator according to claim 1, wherein the housing is produced by a plastic injection molding method.

9. The central actuator according to claim 8, wherein the closure cover is attached at the housing by ultra sound riveting.

10. A central actuator for a magnet valve of a cam phaser, the central actuator comprising:
a housing that envelops the central actuator;
a pole tube and a pole core that are arranged within at least one coil that generates a magnetic field;
an actuation plunger that is arranged at an armature that is axially movable in a direction in an armature cavity;
a closure element that closes the armature cavity,
wherein the closure element includes at least one pole core insert that includes a central bore hole and a support bushing that is arranged in the central bore hole of the at least one pole core insert,
wherein the actuation plunger is supported axially movable in the support bushing,
wherein the closure element includes a closure cover and is provided as a pre-assembled module, and
wherein the support bushing includes recesses that are arranged in the axial direction and provide a pressure compensation between the armature cavity and an outer space of the central actuator.

11. A central actuator for a magnet valve of a cam phaser, the central actuator comprising:
a housing that envelops the central actuator;

a pole tube and a pole core that are arranged within at least one coil that generates a magnetic field;

an actuation plunger that is arranged at an armature that is axially movable in a direction in an armature cavity;

a closure element that closes the armature cavity, wherein the closure element includes at least one pole core insert that includes a central bore hole and a support bushing that is arranged in the central bore hole of the at least one pole core insert, wherein the actuation plunger is supported axially movable in the support bushing, wherein the closure element includes a closure cover and is provided as a pre-assembled module, and wherein the support bushing includes a shoulder on a side that is oriented towards the armature that provided a stop for the armature and limits an axial movement of the armature.

* * * * *